United States Patent [19]

Sakane et al.

[11] Patent Number: 4,781,972

[45] Date of Patent: Nov. 1, 1988

[54] COMPOSITE MATERIAL AND PROCESS FOR MAKING SAME

[75] Inventors: Isamu Sakane, Ohtsu; Satsuki Kawauchi, Yasu; Tadao Sato, Uji, all of Japan

[73] Assignee: I.S.T. Corporation, Shiga, Japan

[21] Appl. No.: 150,492

[22] Filed: Feb. 1, 1988

Related U.S. Application Data

[63] Continuation of Ser. No. 835,876, Mar. 4, 1986, abandoned.

[51] Int. Cl.[4] ..... B32B 9/04

[52] U.S. Cl. ..... 428/265; 427/379; 427/394; 427/385.5; 427/389.8; 428/268; 428/290; 428/422

[58] Field of Search ..... 428/265, 268, 290, 421, 428/422; 427/379, 385 C, 388 C, 394

[56] References Cited

U.S. PATENT DOCUMENTS 4,131,711 12/1978 Attwood ..... 428/422

*Primary Examiner*—Marion C. McCamish

*Attorney, Agent, or Firm*—Wenderoth, Lind & Ponack

[57] ABSTRACT

A heat-resistant fabric coated or impregnated with tetrafluoroethylene resin is baked at such a temperature for such a period of time that only the resin layer is baked without impairing the strength of the fabric substrate because the substrate is not subjected to a high temperature for a long time.

5 Claims, 2 Drawing Sheets

COMPOSITE MATERIAL AND PROCESS FOR MAKING SAME

This application is a continuation of now abandoned application Ser. No. 835,876, filed Mar. 4, 1986.

BACKGROUND OF THE INVENTION

The present invention relates to a composite material made by coating or impregnating a heat-resistant fabric base with tetrafluoroethylene resin and baking the resin, and to a process for manufacturing the same.

As is well known, tetrafluoroethylene resin (hereinafter referred to as "PTFE") has excellent chemical resistance, heat resistance, electrical insulation, self-lubrication and non-adhesiveness, and is finding wide applications in various industrial fields. But, because of these properties, it is difficult to process.

PTFE starts to melt at 327° C., but does not fluidize even above the melting point. So, unlike ordinary thermoplastic resins, it cannot be molded by screw extrusion, injection molding or rolling molding.

One conventional method for forming a baked layer of PTFE on a heat-resistant fabric was to coat or impregnate the fabric with PTFE in the form of powder, aqueous dispersion or paste by applying or immersion, and bake the PTFE. In this method, it has so far been customary to coat a heat-resistant fabric with an aqueous dispersion of PTFE to a thickness of 20 microns or less by applying or immersion, dry at about 90° C. for about 5 minutes, and bake it at 370°–400° C. for 10 to 20 minutes. If it is desired to form the layer to a larger thickness, the abovesaid steps are repeated until a predetermined thickness is reached.

However, if PTFE is baked for a long time, the fabric substrate is also subjected to a high temperature so that its strength is decreased. Glass fiber, for example has a heat resistance of about 600° C. or more. But, by heating at 300° C., 350° C. and 400° C., its strength is diminished to about 72%, 57% and 42% of the original strength, respectively. For all-aromatic polyamides, by heating at 300° C., 350° C. and 400° C., its strength is diminished to about 48%, 30% and 22%, respectively.

Thus, the conventional method for making a composite material having a fabric base with a baked layer of PTFE has a shortcoming that baking impairs the strength of the heat-resistant fabric substrate. With the conventional method, a composite material having a sufficient strength cannot be obtained.

SUMMARY OF THE INVENTION

An object of the present invention is to provide a composite material wih a heat-resistant fabric base with a baked layer of PTFE which has a sufficient strength, and a process for manufacturing the same.

In accordance with the present invention, a heat-resistant fabric coated or impregnated with PTFE is baked at such a temperature for such a period of time that the following equation will be satisfied:

$$-0.147X+170 \geqq t \cdot X \geqq -0.042X+45 \ (X \geqq 400^\circ \text{ C.})$$

wherein X is the baking temperature and t is the baking time.

If the impregnated fabric is baked under such conditions, it will be baked for a short time at a high temperature. This results in that only the layer of PTFE is baked without subjecting the heat-resistant fabric base to the high temperature and thus impairing its strength.

The above equation is graphically represented in FIG. 2. It shows that the desirable baking zone is within an area enclosed by three lines, namely, $$y \leqq -0.147X+170, \ Y \geqq -0.042X+45, \ x \geqq 400,$$

Since y=tx, the baking temperature may be between $X_1$ and $X_2$ if t is variable.

In case a heat-resistant fabric is passed through the baking furnace at a predetermined speed to bake the PTFE coated or impregnated on it, the baking time t will be l/v wherein l is the length of the baking furnace and v is the material running speed. In this case, if the baking temperature X is set to be between $X_1$ and $X_2$, the abovementioned equation will be satisfied. Similarly, the baking temperature may be firstly determined and the baking time t, that is, l/v may be determined on the basis of the baking temperature.

Other objects and features of the present invention will become apparent from the following description taken with reference to the accompanying drawings.

DETAILED DESCRIPTION OF THE PREFERRED EMBODIMENT

Figure 1:
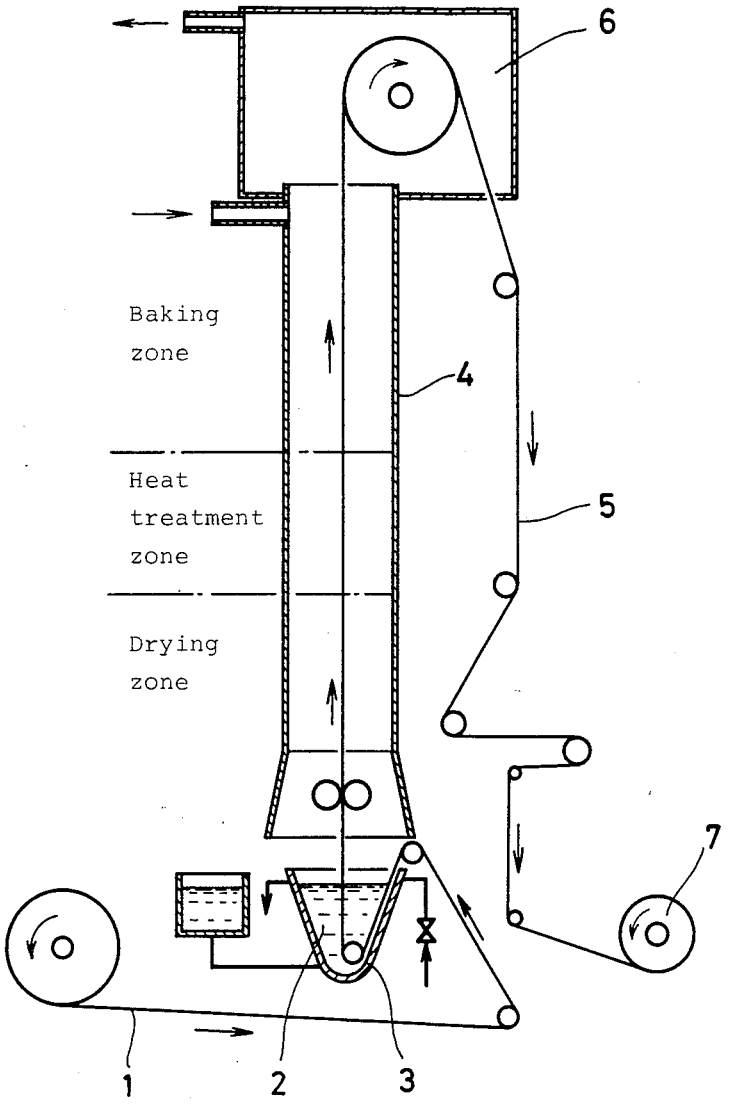
FIG. 1 is a schematic view of an apparatus for manufacturing a composite material embodying the present invention.
Figure 2:
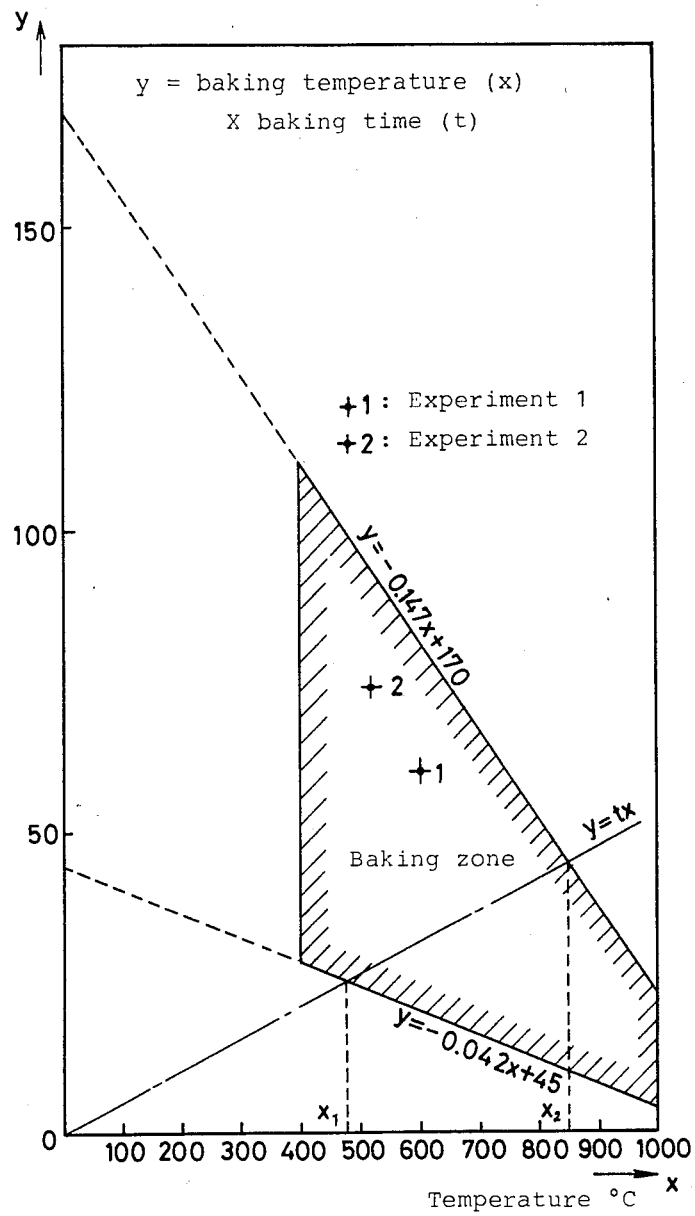
FIG. 2 is a graph showing the relationship between the baking temperature X an the baking time t.

Referring to FIG. 1, a web of heat-resistant fabric material 1 is fed to an immersion tank 3 containing an aqueous dispersion 2 of PTFE. The fabric material impregnated with PTFE is passed through a baking furnace 4 at a constant speed to bake the PTFE. During the baking, the baking temperature X and the web speed V should be controlled so that the baking temperature X and the baking time t (which is the length l of the baking zone divided by the web speed V) will satisfy the following equation:

$$-0.147X+170 \geqq t \cdot X \geqq -0.042X+45 \ (\text{wherein } X \geqq 400^\circ \text{ C.})$$

The baking furnace consists of a drying zone, a heat treatment zone and a baking zone. The abovesaid baking temperature is the temperature in the baking zone, and the baking time is the time taken for the web to pass through the baking zone.

By the abovesaid process, a composite material 5 having a baked layer of PTFE is continuously manufactured, passes through a slow cooling chamber 6, and is wound around a take-up roll 7.

As the heat-resistant fabric, glass fiber, polyamide fiber, carbon fiber, ceramic fiber, polyester fiber, polypropylene fiber, acryl fiber, polyimide fiber and cellulose fiber may be used. The heat-resistant fabric may include a pigment.

As to the manner of how to apply PTFE to the heat-resistant fabric, it may be impregnated with an aqueous dispersion of PTFE; or a paste of PTFE may be applied to the fabric; or powdered PTFE may be applied to the fabric by painting or electrostatic painting. The PTFE used may contain a pigment.

EXAMPLE 1

Glass fiber twisted yarn (ECD 450 4/3 10S) was immersed in an aqueous dispersion of PTFE (Polyfuron D-2 manufactured by Daikin Co., concentration: 60%) to impregnate the yarn with PTFE so that the content of PTFE will be 20%. The impregnated glass fiber yarn was passed through a drying furnace (2 meters long, at 200° C.) and a baking furnace (5 meters long, at 600° C.) at a speed of 50 meters per minute.

The tensile strength of the composite yarn thus obtained was 9.4 kg per yarn, compared with 7.5 kg per yarn for glass fiber yarn not impregnated with PTFE and baked. This means that the tensile strength increased by about 1.25 times.

COMPARATIVE EXAMPLE 1

The same glass fiber twisted yarn, aqueous dispersion of PTFE and apparatus as in the Example 1 were used. The impregnated yarn was baked in the same apparatus but under the conventional baking conditions: namely it was passed through the drying furnace at 90° C. and the baking furnace at 400° C. at a speed of 2 meters per minute.

The composite yarn obtained was apparently the same as the one obtained in Example 1, but its tensile strength was 6.2 kg per yarn, which was about 83% of the tensile strength of the yarn not impregnated and baked.

EXAMPLE 2

Glass fiber cloth (WE05E104) was immersed in an aqueous dispersion of PTFE (AD-1 manufactured by Asahi Glass Co., Ltd.) to impregnate the cloth with PTFE. The impregnated glass fiber cloth was passed through the drying furnace (2 meters long, at 200° C.) and the baking furnace (5 meters long, at 520° C.) at a speed of 35 meters per minute. By repeating the above-said impregnation and baking three times, a composite material was obtained which had a content of PTFE of about 25%.

The tensile strength of the composite material thus obtained was measured. It was 40.2 kg/25 mm in a longitudinal direction and 28.7 kg/25 mm in a lateral direction, compared with 35 kg/25 mm and 25 kg/25 mm for glass fiber cloth not impregnated or baked. This means that the tensile strength increased by about 1.5 times.

COMPARATIVE EXAMPLE 2

The same glass fiber cloth was impregnated with PTFE and baked in the same manner as in Example 2 except that the baking furnace was at 380° C. and the speed was 1.5 meters per minute.

The composite material thus obtained was apparently the same as the one obtained in Example 2. But, its tensile strength was 26.5 kg/25 mm in a longitudinal direction and 19.3 kg/25 mm in a lateral direction, which was lower than before impregnation and baking.

What is claimed is:

1. A composite material prepared by the process comprising the steps of coating or impregnating a heat-resistant fabric with tetrafluoroethylene, drying said tetrafluoroethylene and baking said tetrafluoroethylene at such a temperature for such a time that the following equation will be satisfied:

$$-0.147X+170 \geqq t \cdot X \geqq -0.042X+45$$

wherein t is the baking time in minutes and X is the baking temperature, and $X \geqq 400°$ C.

2. A composite material as claimed in claim 1, wherein said heat-resistant fabric is selected from the group consisting of glass fiber, all aromatic polyamide, carbon fiber, ceramic fiber and a mixture thereof.

3. A process for manufacturing a composite material comprising the steps of coating or impregnating a heat-resistant fabric with tetrafluoroethylene drying said tetralfuoroethylene and baking said tetrafluoroethylene at such a temperature for such a time that the following equation will be satisfied:

$$-0.147X+170 \geqq t \cdot X \geqq -0.042X+45$$

wherein t is the baking time in minutes and X is the baking temperature, and $X \geqq 400°$ C.

4. A process as claimed in claim 3, wherein said drying step is conducted at a temperature of about 200° C.

5. A process as claimed in claim 5, wherein said heat-resistant fabric is selected from the group consisting of glass fiber, polyamide fiber, carbon fiber, ceramic fiber, polyester fiber, polypropylene fiber, acryl fiber, polyimide fiber and cellulose fiber.

* * * * *